US005150852A

United States Patent [19]

Hunt et al.

[11] Patent Number: 5,150,852

[45] Date of Patent: Sep. 29, 1992

[54] PAYOUT TUBE WITH IMPROVED LOCKING MEANS

[75] Inventors: Rodney J. Hunt, Omaha, Nebr.; Ruloff F. Kip, Jr., New Castle, N.Y.

[73] Assignee: AT&T Bell Laboratories, Murray Hill, N.J.

[21] Appl. No.: 796,564

[22] Filed: Nov. 21, 1991

[51] Int. Cl.[5] ..... B65H 57/12; B65H 57/18; B65H 49/08

[52] U.S. Cl. ..... 242/157 R; 242/137.1; 242/163; 242/171

[58] Field of Search ..... 242/157 R, 163, 170, 242/171, 159, 129, 129.5, 137, 137.1, 138, 146, 129.7

[56] References Cited

U.S. PATENT DOCUMENTS

| | | | |
|---|---|---|---|
| 4,009,845 | 3/1977 | Santucci et al. | 242/129.7 |
| 4,022,399 | 5/1977 | Zajac | 242/163 |
| 4,057,203 | 11/1977 | Newman et al. | 242/163 |
| 4,057,204 | 11/1977 | Zajac | 242/163 |
| 4,160,533 | 7/1979 | Kotzur et al. | 242/137.1 |
| 4,274,607 | 6/1981 | Priest | 242/163 |
| 5,064,136 | 11/1991 | Hunt | 242/157 R |

*Primary Examiner*—Stanley N. Gilreath
*Attorney, Agent, or Firm*—R. F. Kip, Jr.

[57] ABSTRACT

The invention is for improvements in a payout tube for a container-packaged coiled cable in which the tube in use is in the container along with the coil, a stub of the tube at its exit end protrudes through a hole in a container wall, and the tube is secured to that wall by having portions of the wall around the hole interposed between (a) a flange or flanges disposed on the tube on one side of such wall in contact with such portions, and (b) locking elements axially spaced on the tube from such flange or flanges and disposed on the other side of such wall in contact with such portions. Here, such locking elements are struts coupled to the body of the tube to be movable between radially inner positions at which they will pass through such hole and radially outer positions at which they cooperate with the flange means to secure the tube to such wall as described above. In all disclosed embodiments of the tube, such struts are integral with the tube body and project into apertures formed therein as extensions of such body. Such struts may constitute axially elongated legs coupled at their base ends to such body and having free ends resiliently deflectable relative to such base ends and disposed in adjacent axially spaced relation with such flange means. Alternatively, such struts may constitute shutters joining to the tube body by resilient hinges and pivotable about such hinges between such radially inner and outer positions. The hinges are preferably linear and may be aligned either parallel or slanted in relation to the tube axis. The shutters may be resiliently deformable so as to deflect upon contacting such wall portions to exert yieldable force thereon. One or more of such shutters may pivot about their hinges in opposite of the clockwise and counterclockwise directions in moving from radially inner to outer position. The shutters may include fender tabs which retain them in radially outer position once they have been moved thereto.

13 Claims, 10 Drawing Sheets

PAYOUT TUBE WITH IMPROVED LOCKING MEANS

FIELD OF THE INVENTION

This invention relates generally to devices for dispensing a filamental article (as, say, insulated wire, stranded cable or the like) from a coil of such filament. More particularly, this invention relates to devices of such kind in which the filament is stored in a coil in turn packaged in a box or other container, and in which the dispensing device consists of a payout tube which is mostly disposed in the container but has a stub received in a hole in a wall of the container to provide a passage from its inside to its outside for filament led from the coil through the tube.

BACKGROUND OF THE INVENTION

U.S. Pat. No. 4,057,204 issued Nov. 8, 1977 in the name of R. E. Zajac to Windings, Inc. ("Zajac") discloses a payout tube of the described sort in which an annular flange encircles the tube and the tube has at such end, outward of the flange, on diametrically opposite sides of the tube, a pair of projections which extend radially out from the tube to lie over the flange and which are shown as being of triangular cross section in planes normal to the radial center lines of the projections. The walls of such projections towards that flange are planar and slope in opposite directions as seen in a direction along the tube diameter between those centerlines.

The Zajac tube is secured in position within the container by (a) providing in a wall of the container a circular hole of the tube's diameter and having equiangularly spaced around it a pair of notches formed in the hole's circumference for receiving the tube projections, (b) positioning the tube inside the container to pass a stub portion of such tube through such hole, and such projections from inside to outside through such notches, until the tube flange bears against such wall around the circumferential margin of the hole, and (c) then turning the tube 90° to cause portions of the wall around the tube to be interposed between such flange and the tube projections to thereby secure the tube to the wall. According to the Zajac patent as it is understood, what happens in the course of such turning is that, because the space between the flange and the axially inner edges of the sloping projection walls towards the flange is a space less than the wall thickness of the container, the turning of the tube causes the inclined lower surfaces of the projections to ride up on the box material and grip into it to prevent accidental turning of the tube to an improper position. The Zajac patent also indicates in its abstract that improper turning of the tube is avoided because the effect of the tube projections on the box material is that the projections "dig into it".

The Zajac tube has features which may lead to the following disadvantages. First, the digging into the box material by the sharp inner edges of the tube projections may macerate the box material or otherwise weaken it so that it will no longer provide sufficient support to anchor the tube to the box. Second, the sharp leading outer edges of the triangular cross sections of the Zajac projections tend, at the beginning of turning of the tube, to dig into the box material and damage it and prevent further turning of the tube. Other disadvantages are that the Zajac tube cannot be used with a circular hole which lacks the mentioned notches, the tube is not well adapted for use with container walls of variable thickness; and the tube is prone to inadvertent reverse turning and consequent decoupling of the tube from the container wall.

SUMMARY OF THE INVENTION

One or more of such disadvantages are avoided according to the invention by a payout tube comprising:

a tubular sleeve having an axis and having an axial passage therein with rear and front openings at entrance and exit ends of said sleeve for a cable to be led out therethrough, said sleeve being adapted in use to be mostly within the mentioned container but to have a portion at the exit end of the sleeve extending out through and beyond the mentioned hole in the container wall, flange means radially projecting at such exit end away from the periphery of such sleeve, and a plurality of struts coupled to, and angularly spaced around, said sleeve and extending from rearward of such flange means axially forward to free ends of said struts disposed near said flange mean in axially spaced relation therefrom, said struts being radially movable between inner positions at which they are passable through said hole and outer positions at which said flange means and said struts are adapted to bear against opposite sides of portions of said wall adjacent said hole so as to couple said tube and container.

BRIEF DESCRIPTION OF THE DRAWING

For a better understanding of the invention, reference is made to the following description of exemplary embodiments thereof, and to the accompanying drawings wherein.

In the description which follows, the term, "angular" refers in a system of polar coordinates to the angular direction around the payout tube, and where elements are designated by the same reference number but by different alphabetical suffixes to that number, these elements are counterparts of each other, and a description of one is, unless the context otherwise indicates, equally applicable to its counterpart(s).

DETAILED DESCRIPTION

Figure 1:
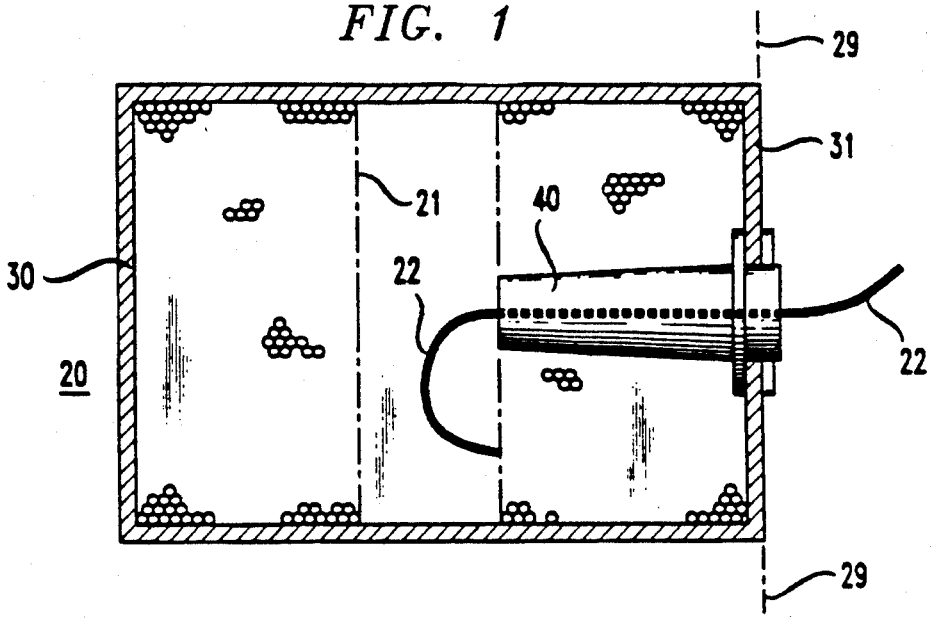
FIG. 1 is a schematic front elevational view, partly in cross-section, of the assemblage of a coil of filamental material, a container in which such coil is packaged, and payout tube constituting one exemplary embodiment of the invention and disposed in the container for dispensing from the container the filament payed out from the coil.

Referring now to FIG. 1, the reference number 20 designates an assembly of a coil 21 of a filamental material packaged in a container 30 in which is a payout tube 40 for dispensing lengths of such material from the container. A filament 22 of such material is shown as extending from coil 22 through tube 40 to the outside of container 30. The filament 22 depicted is an insulated electrical cable but the invention is not limited for use only with such cable.

The coil 21 may comprise superposed layers of filament in FIG. "8" configurations in which the crossovers of the configurations in successive layers migrate around a central core for the coil. Coils of such kind are disclosed in U.S. Pat. No. 4,057,204 and U.S. Pat. No. 4,274,607.

The container 30 is in the form of a box having a square bottom and top joined by vertical rectangular side walls including a wall 31 on the right side of the box. The undeformed outer surface of wall 31 defines a plane 29. The bottom, top and side walls of box 30 are constituted of corrugated or uncorrugated cardboard or filberboard or other packaging material adapted when constituting a portion of a wall or other panel to be resiliently flexible over a useful range of deformation.

As so far described the assemblage 20 is disclosed in U.S. Pat. No. 5,064,136 to Rodney J. Hunt for "Payout Tube To Container Packaged Coil Filament" and assigned to the assignee hereof, such applicaton being incorporated herein by reference and made a part hereof.

Figure 2:
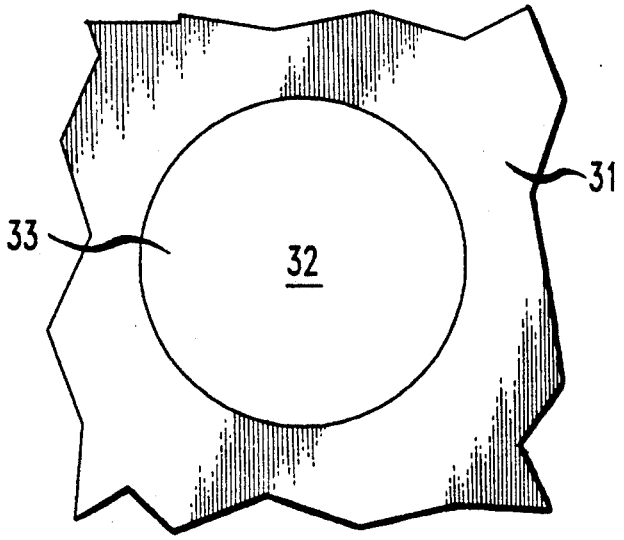
FIG. 2 is a fragmentary right side elevation of the FIG. 1 assemblage showing in an enlarged manner the hole in the right side wall of the container.

Wall 31 has formed therein (FIG. 2) a hole 32 bounded by a circumferential margin 33 provided by wall 31.

It will be noted that the hole 32 differs from that disclosed by Zajac in that hole 32 is circular, i.e., has no notches extending radially outward into the wall 31 from the primary circular circumference 33 of the hole.

Figure 3:
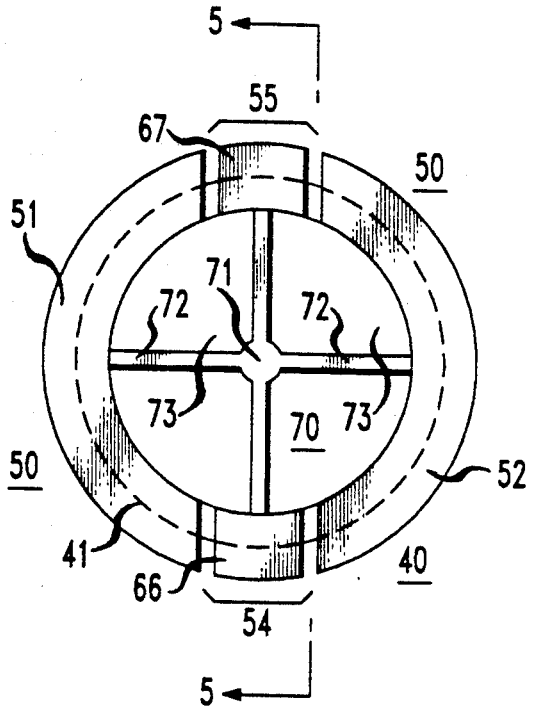
FIG. 3 is a plan view of the tube shown in the FIG. 1 assemblage when that tube is rotated ninety-degrees so that its exit end is at the top of the tube.
Figure 4:
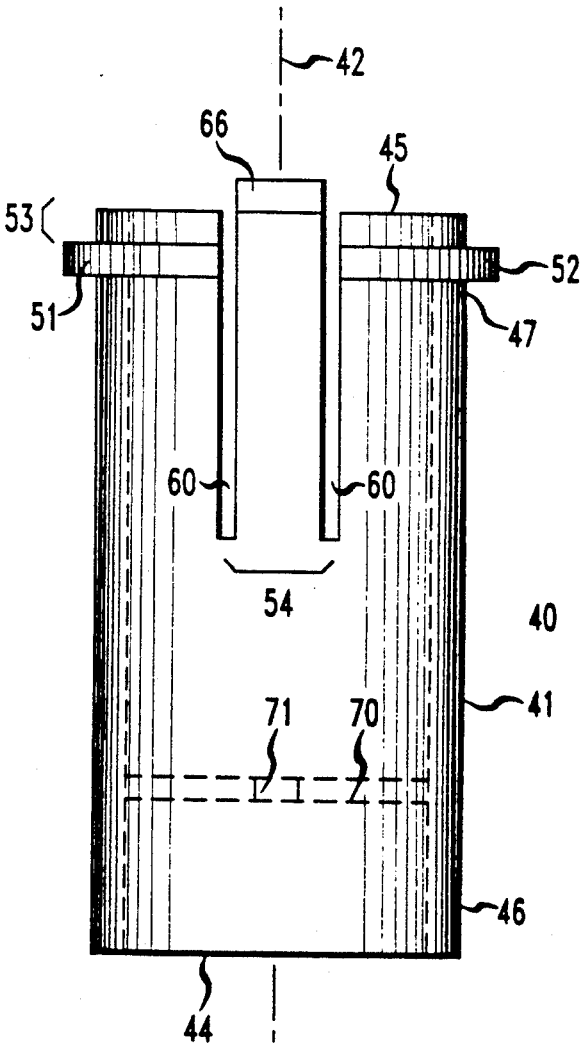
FIG. 4 is a front elevation of the FIG. 3 tube.
Figure 5:
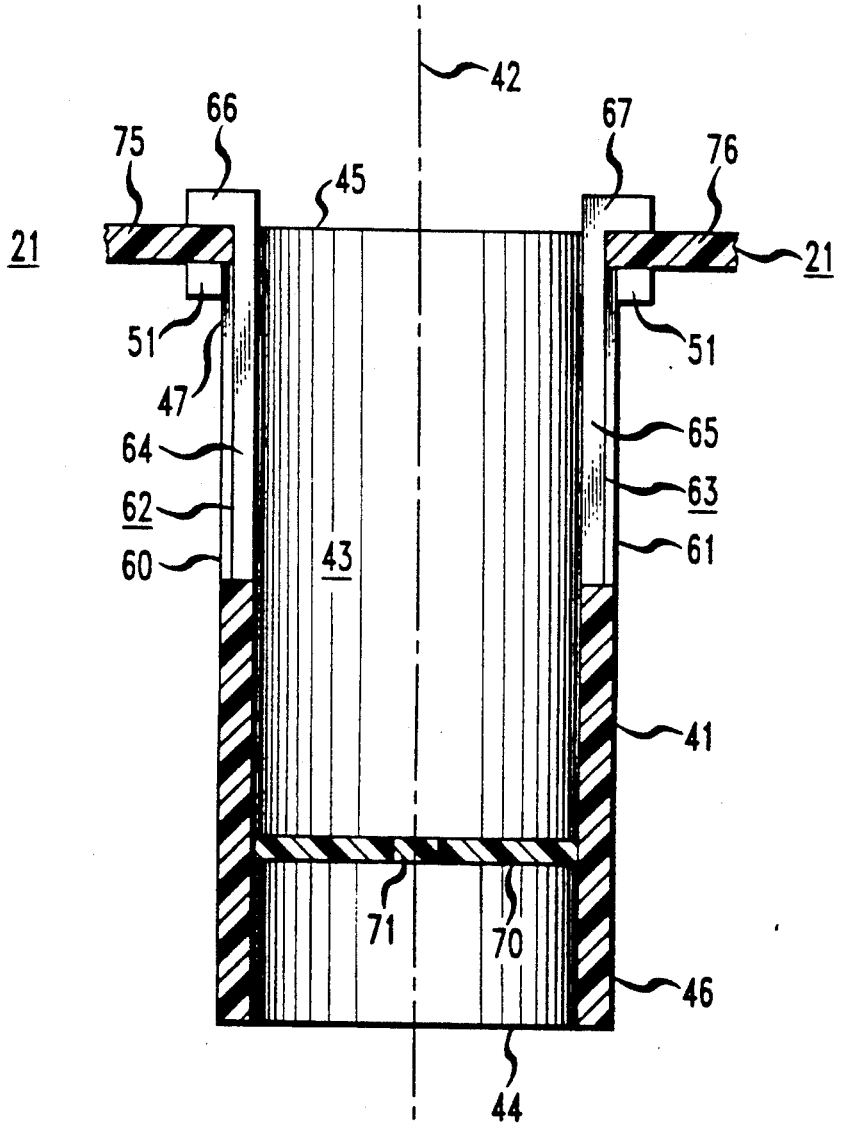
FIG. 5 is a right side elevation in cross-section, taken as indicated by the arrows 5—5 in FIG. 3, of the FIG. 3 tube, the tube being shown as received in the hole in the container.

The payout tube 40 comprises (FIGS. 3–5) a molded synthetic resinous tubular sleeve 41 having an axis 42 and having therein a passage 43 with rear and front openings 44 and 45 disposed at, respectively, an entrance end 46 and an exit end 47 for cable 22 when led through the tube 40. The sleeve 41 is depicted in FIGS. 4 and 5 as having a circular cylindrical exterior. In practice, however, such exterior may have a convergent taper from its exit end 47 to its entrance 46 as shown in U.S. Pat. No. 5,064,136 for the tube disclosed therein.

The sleeve 41 has at its exit end a flange means 50 radially projecting from the periphery of the sleeve. Flange means 50 consists of two separate flanges 51 and 52 displaced rearward of the sleeve's front opening 45 by an axial space 53, the flanges extending around the sleeve on opposite sides thereof so that the angularly opposite ends of the two sleeves are separated by angular gaps 54 and 55.

At the angular locations of those gaps, the sleeve 41 has formed therein a pair of apertures 60, 61 in the form of slots extending in the sleeve from substantially rearward of the flanges 51 to 52 axially forward all the way to front opening 45 at which these slots have terminations adjacent to the flange means 50.

Received in these slot apertures are a pair of struts 62, 63 comprising axially elongated legs 64, 65 coupled at their bases, at the rear ends of slots 60, 61, to the main body of sleeve 41. Legs 64 and 65 are integral with said sleeve and constitute synthetic resinous extensions thereof. As shown, the legs 64, 65 extend from their couplings with sleeve 41 axially forward for the full lengths of slot apertures 60, 61 to front opening 45. Axially beyond that opening, the legs 64, 65 at their free ends carry strut components in the form of tabs 66, 67 integral with the legs and projecting radially outward therefrom normal to the lengths of the legs. When legs 64, 65 are in positions shown in FIG. 5, the undersides of the end tabs 66, 67 are coplanar with the front opening 45 of the sleeve, axially face towards the gaps 54, 55 radially project out to the same extent as the flanges 51, 52, and are separated in the axial direction from the upper sides of those flanges 50, 51 by the axial spacing 53.

The tube passage 43 has in it, towards its rear opening 44, a diaphragm 70 extending transversely across the passage and having formed in it a small hole 71 and slots 72 radiating from such hole to divide the diaphragm into resilient fingers 73 surrounding hole 71. As explained in more detail in U.S. Pat. No. 5,064,136 , the elements 70–73 form a device which yieldingly opposes retrograde movement of a length of cable 22 which has been led forward through the hole 71 in the diaphragm.

The synthetic resinous material of which the strut legs 64, 65 composed is resiliently deformable. Accordingly, the struts 62, 63 (which include the end tabs 66, 67) are resiliently deflectable, relative to their base ends at the bottoms of slots 60, 61. By such deflection the free ends of the struts may be moved between radially outer and radially inner positions. The radially outer position for the struts is when they are resiliently unstrained and is shown in FIGS. 3 and 5. The desired radially inner position for the struts is when they have been radially deflected inwards far enough to permit struts 62, 63 to pass with clearance through the circular hole 32 in container wall 31. To reduce the stiffness of struts 62, 63 to radial deflection, the radial thickness of their legs 64, 65 may be reduced and/or such legs may be configured to have a horizontal cross-section in the form of a rectangle rather than an arcuate section.

USE OF FIG. 3 TUBE

The FIG. 3 tube is used as follows. With the tube being initially held inside the container 30 so that its exit end 47 is slightly spaced from the container hole 32, and the tube is coaxially aligned with that hole, the legs 64, 65 are contacted by the jaws of a pliers tool (not shown). The tool is manipulated to deflect the legs radially inward until the separation between the radially outer faces of the strut end tabs 66, 67 is less than the diameter of hole 32. With the strut legs being gripped by the tool to be deflected to that degree, the tube 40 is axially advanced towards container wall 31 to pass its front opening through and beyond hole 32 and to bring the flanges 51 and 52 on the tube to bear against portions 75, 76 of the container wall 31 which are distributed around and border the hole 32. Once the flanges 51, 52 contact the inner sides of those wall portions, further axial movement of the tube 40 towards container wall 31 is stopped. Thereupon, the strut legs 64, 65 are released from the grip of the pliers tool, and the struts 62, 63 spring back from their inner positions to which they have been deflected to their outer positions shown in FIGS. 3 and 5. Such restoration of the struts to their normal resiliently unstrained positions is made possible by the fact that the axial thickness of the wall portions 75, 76 of container wall 21 is the same as, or less than, the axial spacing 53 between the outer sides of strut end tabs 66, 67. Indeed, that wall portion thickness may be slightly greater than spacing 53. Such latter thickness relation is disclosed (for a similar configuration of container wall portions and stop means on the payout tube) by a diagram in FIG. 8 of U.S. Pat. No. 5,064,136 and an explanation in such reference of that diagram. In any event, when the container wall portions 75, 76 are interposed between the flanges 51, 52 and the strut end tabs 66, 67 are as shown in FIG. 5 hereof, movement (except possibly for play) of tube 40 in either axial direction relative to container 30 is stopped by contact between such portions 75, 76 and elements 51, 52 or 66, 67. The tube 40 is thus securely coupled inside container 30 to its wall 31.

DETAILED DESCRIPTION OF FIG. 6 TUBE

Figure 6:
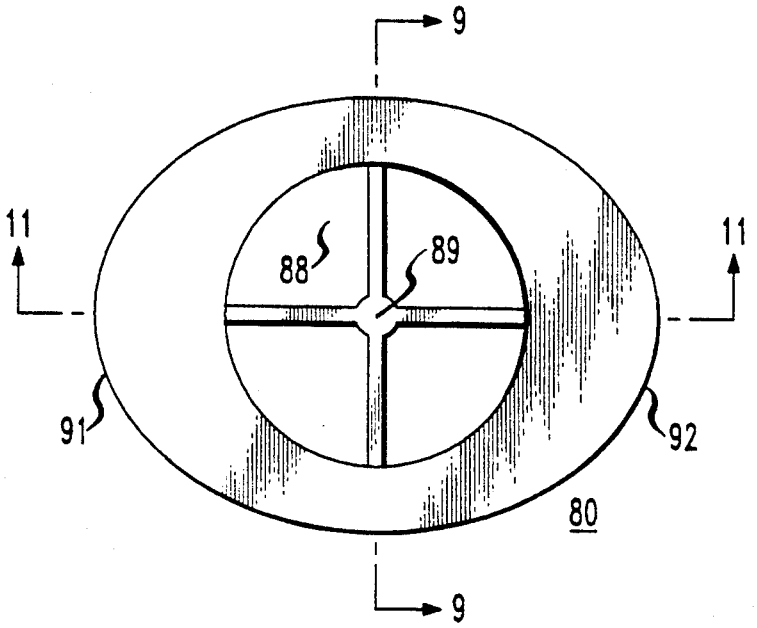
FIG. 6 is a plan view of a payout tube constituting a second exemplary embodiment of the invention.
Figure 7:
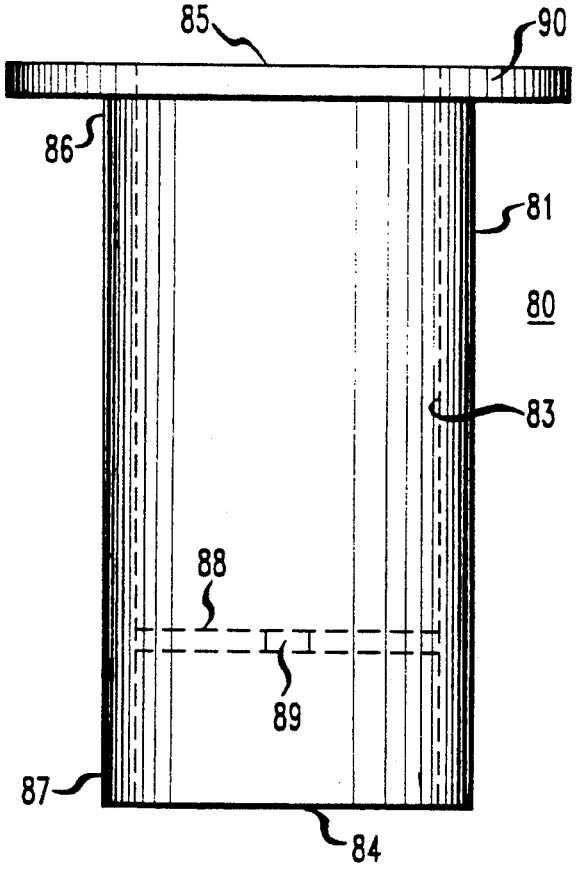
FIG. 7 is a front elevation of the FIG. 6 tube.

Turning now to FIGS. 6–11, the FIG. 6 tube 80 resembles the FIG. 3 tube in comprising a molded synthetic resinous tubular sleeve 81 having an axis 82 and having therein a passage 83 axially extending between rear and front openings 84 and 85 for the passage. Openings 84 and 85 are at ends 86 and 87 of sleeve 81 which are entrance and exit ends, respectively, for the purpose of leading the cable 22 through tube 80.

The passage 83 has therein, towards the sleeve's entrance end 84, a slitted diaphragm 88 which has a small central axial aperture 89 and which, like the similar diaphragm 70 of the FIG. 3 tube, is adapted to yieldingly oppose retrograde movement of a length of cable 22 led forward in passage 83 through the diaphragm aperture 89. A portion of the exterior of sleeve 81 at and near its entrance end 84 may have a convergent taper (not shown) towards that end to aid in inserting the tube in container hole 32.

The tube sleeve 81 has, at it exit end 86 a flange means 90 projecting radially from the periphery of the sleeve. Such flange means is shown as extending continuously around the sleeve. It may alternatively take the form of a plurality of radially projecting arcuate sectors extending sequentially angularly around the sleeve and separated by angular gaps. The circumference of flange 90 departs from circular to the extent that, at its left and right hand ends (FIG. 6), the flange has lobes 91 and 92 extending radially farther out than the rest of the flange. As shown, the outer side of flange 90 is coplanar with the front opening 85 of tube 80, i.e., is not set off from that opening by an axial spacing as in the case of the flanges 51, 52 of the FIG. 3 tube.

Formed in opposite sides of the sleeve 81 are a pair of window apertures **100*a*, 100*b* extending from rearward of flange 90 axially forward to terminations of such apertures short of but adjacent to the axially rear side of flange 90. The apertures 100*a*, 100*b* have received therein a pair of radially movable struts 101*a*, 101*b* in the form of shutters of which the shutter 101*a*** will first be considered.

Figure 8:
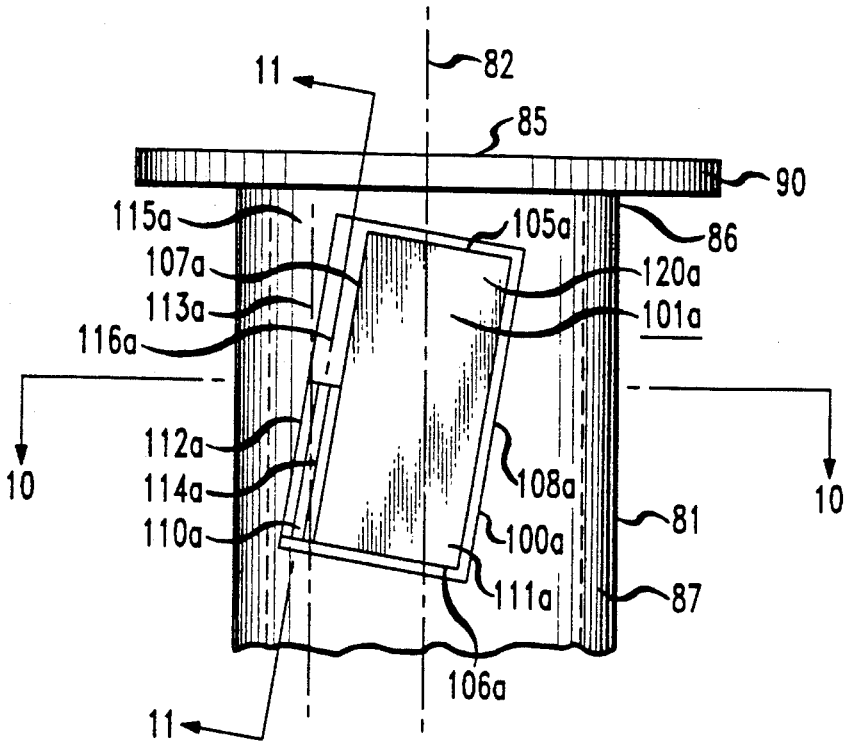
FIG. 8 is an enlarged broken-away left side elevation of the FIG. 6 tube.
Figure 9:
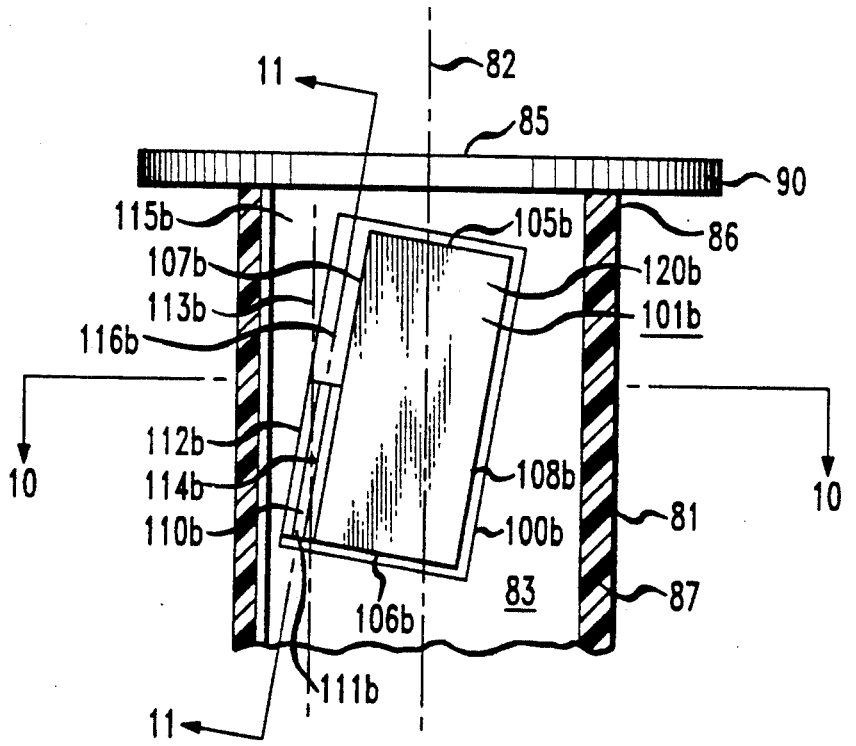
FIG. 9 is an enlarged broken-away left side elevation in cross-section, taken as indicated by the arrows 9—9 in FIG. 6, of the FIG. 6 tube.

Shutter **101*a* is in the shape of a rectangle having a forward edge 105*a*, a rearward edge 106*b*, and inner and outer edges 107*a*, 108*a*. That shutter is a synthetic resinous part integral with sleeve 81 and is coupled by resilient hinge 110*a* to the sleeve such that the shutter constitutes an extension into the aperture 101*a* of the main body of the sleeve. The use for other purposes of resilient hinges in cable payout tubes is disclosed in U.S. application Ser. No. 07/633,887 filed Dec. 26, 1990 in the name of R. J. Hunt and assigned to the assignee hereof and incorporated herein by reference and made a part hereof. As shown in FIG. 8, the hinge 110*a* joins a lower hinged section 111*a* of the shutter at its inner edge 107*a* to the portion 112*a* of sleeve 81 bordering aperture 100*a* on its left hand side (FIG. 8**).

The hinge **110*a* is formed in the course of molding of sleeve 81 by creating a groove between regions 107*a* and 112*a* both in the outer wall surface of sleeve 81 and in the inner bounding wall surface of the sleeve's passage 83 so as, by such grooves to reduce the radial thickness of the sleeve between these two regions. The hinge 110*a* is skewed in relation to the axis 82 of tube 80 in the sense that the hinge centerline 116*a* makes an acute angle with a line 113*a* parallel to that axis and passing at an intersection 114*a* through the center line of the hinge. Line 113*a* may be considered to represent a particular position of the generatrix line which moves around and parallel to axis 82 (the directrix line) to generate the cylindrical configuration of sleeve 81. The hinge 110*a* angularly extends in that configuration over a portion 115*a* of it which is a "flat" (rather than being circular cylindrical) in order for hinge 110*a*** over its extent to be linear rather than conforming to a segment of a helix.

The strut or shutter **101*a* has above its lower hinged section 111*a* a free standing section 120*a* terminating at its free end in the forward edge 105*a*. Edge 105*a* conveniently (but not necessarily) is rounded in a vertical cross-section through section 120*a*. The free end of that section or "tongue" 120*a* is resiliently deflectable in the radial direction relative to the hinged section 111*a* of the shutter. To enhance such deflectability, the tongue 120*a* of the shutter may be reduced in thickness relative to the shutter's hinged section 111***a*, and the tongue may be made rectangular, rather than arcuate, in its cross section normal to the hinge center line 116*a*.

The radially movable shutter or strut 101*b* in its structure, elements and coupling to sleeve 81 is the counterpart of shutter 101*a* with the exception that shutter 101*b* (FIG. 9) is the mirror image of shutter 101*a*. That is, if one were to view tube 80 from directly outward of shutter 101*b*, that shutter would be joined to sleeve 81 by hinge 110*b* at the shutter's right hand edge 107*b* rather than its left hand edge as the case is with shutter 101*a*.

Figure 10:
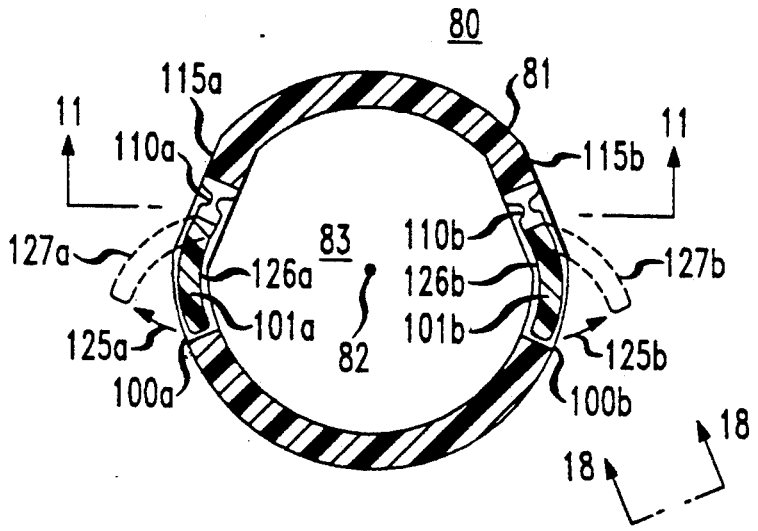
FIG. 10 is a plan view in cross section, taken as indicated by the arrows 10—10 in FIGS. 8 and 9, of the FIG. 6 tube, the struts of the tube being shown in partially radially extended positions.

As shown in FIG. 10 the shutters 101*a*, 101*b* are pivotable about their respective resilient hinges 110*a*, 110*b* to be movable between radially inner positions and radially outer positions represented in FIG. 10 by, respectively, the solid line and phantom showings of each such shutter. These shown inner and outer shutter positions do not necessarily correspond to end limit positions of such shutters in the range of positions they can assume in swinging around their hinges. As a matter of convenience rather than necessity, the resilient hinges 110 may be formed to be resiliently unstrained when the shutters 101 are in their radially inner positions shown in FIG. 10 to thereby bias these shutters to remain in such position.

USE OF THE FIG. 6 TUBE

In the case of the FIG. 6 tube, it is inserted into the container hole 32 from an initial position of the tube outwards of the container 30. That is, the tube is held outside the container with the tube's entrance end 84 being adjacent to hole 32 and the tube being coaxial therewith, and the tube is then moved relative to the container to insert the tube sleeve 81 into and through hole 32 until the flange 90 on the sleeve bears against the outside of container wall 31 so that the previously described portions 75, 76 of the container wall 31 are (FIG. 11) contacted by the lobes 91, 92 on the flange 90. During such insertion of the sleeve, the tube shutters 101 are maintained in positions sufficiently radially inward (FIG. 10) to enable these shutters to pass with clearance through hole 32.

Figure 11:
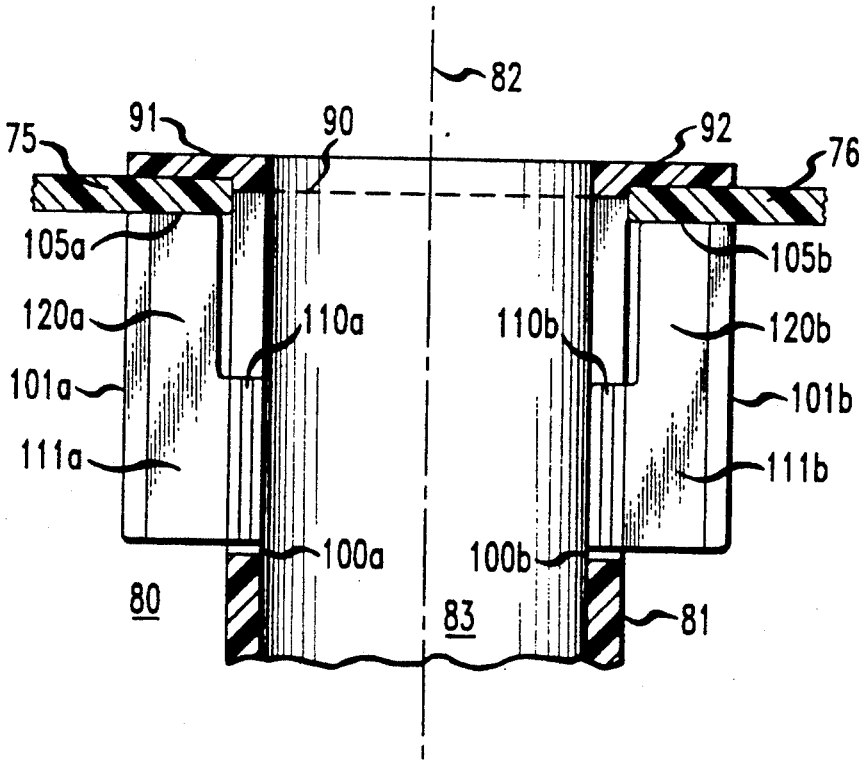
FIG. 11 is a broken-away front elevation in cross-section, taken as indicated by the arrows 11—11 in FIG. 10, of the FIG. 6 tube, the struts of the tube being shown in full radially outer positions, and the tube being shown as received in the container hole.

With tube flange lobes 91, 92 being kept in contact with container wall portions 75, 76, the shutters 101 now inside the container are manipulated by hand or an appropiate tool so as to be pivoted, as indicated by arrows 125*a*, 125*b* in FIG. 10, about their hinges from their previous radially inner positions 126*a*, 126*b* to radially outer positions 127*a*, 127*b* (axially opposite the lobes 92, 91 of tube flange 90) by moving the shutters through an angular range which may vary but which may be as great as ninety degrees. FIG. 11 shows the shutters 110 when they have been moved radially outward from their initial inner positions through an angle of about forty-five degrees.

Figure 12:
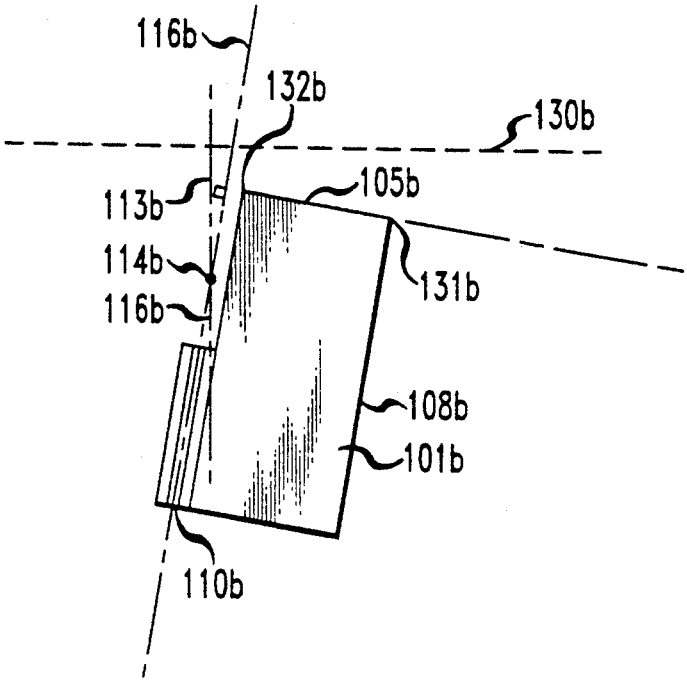
FIG. 12 and 13 are geometric diagrams illustrative of the feature that, in the case where a strut is coupled to the sleeve by an appropriately slanted resilient hinge, a pivoting of the strut around the hinge results in axial displacement forwards of the outer end of the shutter.
Figure 13:
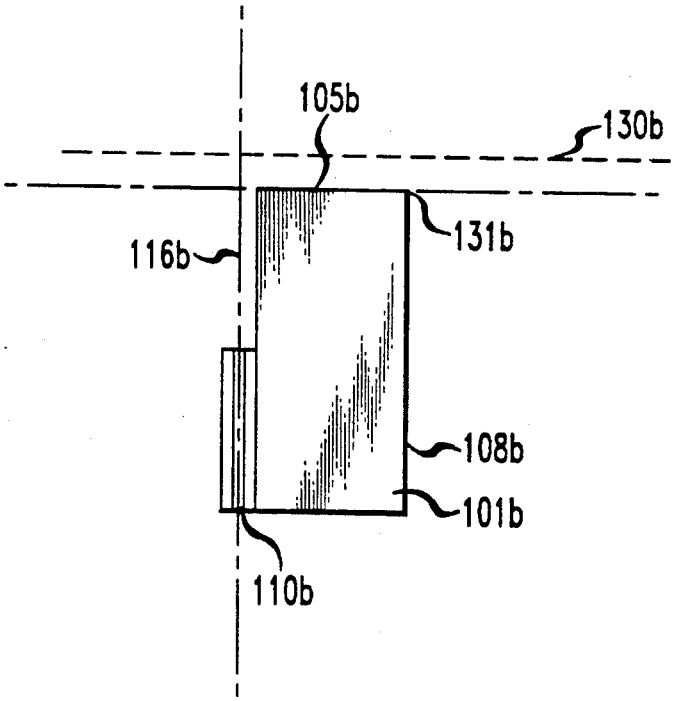

Consideration will now be given to the geometric diagrams which constitute FIGS. 12 and 13 and which illustrate the effect of the previously described skewing (relative to tube axis 82) of hinge 110*b* on the positions of shutter 101*b* as it moves from its initial inner position radially outward by pivoting through an angular range about its hinge. FIG. 12 represents a left side elevation view of that shutter, taken from inside the sleeve passage 83 and looking radially outward, when shutter 101*b* is in its radially inner position. FIG. 12 represents a front elevation of the same shutter when it has been pivoted from such inner position through an angular range of ninety degrees about its hinge 110*b* to a radially outer position therefor. In FIGS. 12 and 13, the forward edge 105*b* of the shutter is shown to be (but is not required to be) normal to the centerline 116*b* of the hinge. Moreover, in both FIGS. 12 and 13, the dash line 130*b* represents a plane parallel to the undersurface of the flange 90 of the tube 80.

Comparing FIGS. 12 and 13, it will be evident that, as the shutter 101*b* pivots through an angular range from its initial inner position (FIG. 12) to its final outer position (FIG. 13) the slant of the hinge 110*b* causes the shutter's top edge 105*b* in the course of such pivoting to undergo a progressive incremental displacement axially forward towards the plane 130*b*. That displacement is greatest at the corner 131*b* of shutter 101 at which its top edge 105*b* and outer edge 108*b* intersect, but it occurs elsewhere along that top edge. Specifically, such incremental displacement is close to zero at the inner top corner 132*b* of the shutter and varies directly with distance away from hinge center line 116*b* to its maximum value at corner 131*b*. Also, the amount of such axially forward incremental displacement of the shutter's top edge 105*b* varies directly with the angular displacement of the shutter away from its initial radially inner position in pivoting towards its radially outer position. Any increase in the value of the incremental forward displacement of any point on the shutter edge 105*b* produces of course, a corresponding decrease in value in the axial distance of such point away from the plane 130*b*.

Now consider the practical effect of having such incremental forward displacement occur when, as shown in FIG. 11, the shutter 101*b* pivots about its hinge 110*b* to move radially outward and, concurrently, the container wall portion 76 is axially interposed between that shutter and the sleeve flange 90. As the shutter so pivots, its incremental axial forward displacement will cause it to first contact the inner side of wall portion 76 and then, as angular radially outward movement of the shutter continues, to compress to a progressively greater degree the wall portion 76 between flange lobe 92 in its outer side and the shutter 101*b* on its inner side. The act of forcing the shutter to pivot further angularly is ended when it is not desired to compress the wall portion further because of abrading or other damage which might be done to it by further shutter movement. At this stopping point of the shutter, the friction between wall portion 76 and the shutter will tend to retain the latter in the position in its pivoting range which it has reached when stopped.

From what has been said, it will be clear that the tight gripping of the wall portion 76 between flange 90 and shutter 101*b* is caused at least in part by a wedging action. That action, however, is not primarily produced by the shape of the surfaces of elements 90 and 101*b* which contact that wall portion but, rather, by relative motion which occurs between these elements, and which has a small axial component of motion compared to its normal-axial component of motion.

Figure 18:
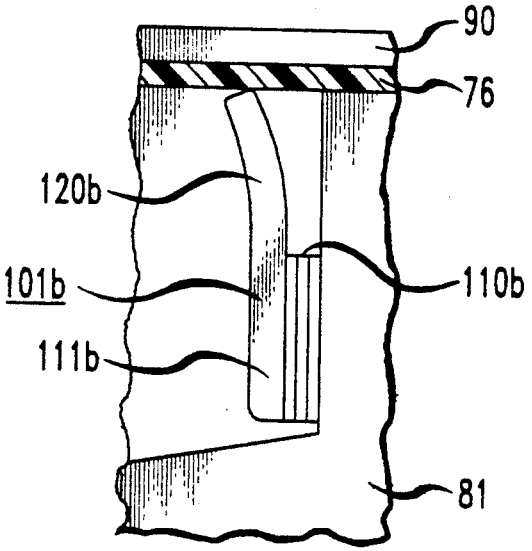
FIG. 18 is a fragmentary view in elevation, taken as indicated by the arrows 18—18 in FIG. 10, of the shutter 101*b* when in its radially outer position shown in phantom in FIG. 10.

While the frictional holding in stopped position of shutter 101*b*, by such wedging action in itself may be adequate to retain the shutter in its stopped position, the stableness of that holding is augmented by the effect of the resilient deformability of the upper tongue 120*b* of the shutter 101*b*. That is, as the shutter is forced radially outward by hand or tool to compress more and more the container wall portion 76, the frictional drag on the upper free end of the tongue 120*b* causes the tongue to be resiliently bent backwards as shown in FIG. 18 to thereby exert on wall portion 76 a progresively increasing yieldable force produced by the resilient strain induced in the tongue by its bending. When radially outward movement of the shutter is stopped, that yieldable force remains to inhibit loosening over the long term of the coupling together of the wall portion 76 with the flange 90 and shutter 101*b* of the tube 80.

It is noted at this point that shutter 101*b* may, as earlier mentioned, be held fixed in radially outer position by friction produced by the use of the described wedging action without any significant resilient deflection of the shutter, or alternatively it may be held, by friction produced by the use of the described resilient deflection of the shutter without there being any accompanying wedging action of the sort described above. That shutter may be held so fixed by such wedging action alone in instances where the shutter is too stiff or otherwise not adapted to undergoing significant resilient deformation in response to the force applied to the shutter in the course of moving it to produce such wedging action. Conversely, the shutter may be held so fixed by, alone, its resilient deformation (as depicted in FIG. 18) in instances where the hinge 110*b* of shutter 101*b* is parallel to the axis 82 of tube 80 so that the above-described wedging action is not produced but where, on the other hand, the axial thickness of the container wall portion 75 is greater than the axial spacing between the underside of flange 90 and the top edge 105*b* of the shutter when it is resiliently unstrained. In those latter instances, the shutter's upper part 120 will necessarily be resiliently deflected by contact with that wall portion initially at the margin 33 of container hole 32 (FIG. 2) in the course of swinging the shutter from radially inner to radially outer position.

Preferably, however, the container 30 and the tube 80 inside it are, maintained in coupled relation at shutter 101*b* by the combination of friction force produced by wedging action and yieldable pressure force produced by resilient deformation.

The hinge 110*a* of shutter 101*a* is slanted like the hinge of shutter 101*b*, and the upper tongue 120*a* of shutter 101*a* is resiliently deformable like the tongue 120*b* of shutter 101*b*. Hence, when the shutter 110*a* is pivoted about its hinge from its radially inner position (FIG. 10) to its radially outer position (FIG. 11) at which the shutter is axially opposite flange lobe 91 on the tube sleeve, the container wall portion 75 will (similar to what has been described for portion 76) be compressed and gripped between flange 90 and shutter 101*a*. Also similarly, that shutter 101*a* will be retained in its final outward position by the combination of friction from the wedging action incidental to the pivoting of the shutter round its hinge and yieldable force arising from the resilient deformation of the tongue 120*a* of the shutter 101*a*. There is, however, between the respective effects produced in moving shutters 101*a* and 101*b* to their outer positions a difference which is as follows.

As earlier mentioned, the hinges 110*a* and 110*b* for the shutters 101*b*, 101*b* are left hand and right hand hinges, respectively, and as a result, shutters 101*a* and 101*b* pivot clockwise and counterclockwise, respectively, in moving (FIG. 10) to their outer positions.

In the case of the grip on container wall portion 76 by shutter 101*b*, for example, there may be, just considering that shutter, a tendency for such grip to become loosened or relaxed over time by casual relative rotation between tube 80 and container 30 around tube axis 82 in a direction tending to reduce or eliminate the wedging action produced by the angular pivoting of shutter 101 to outer position and, thus, to undo the gripping effect resulting from that wedging action and/or the resilient deflection of the shutter tongue 120*b*. Such unwanted relative rotation between elements 80 and 30 would in the case of shutter 101*b* be counterclockwise for tube 80 (FIG. 10) relative to the container, and such counterclockwise rotation would tend to pivot the shutter clockwise from its final outer radial position back towards its inner position to thereby diminish the mentioned wedging action of the shutter (and the resilient deflection of its tongue 120*b*) to the extent such retrograde pivoting of shutter 101*b* occurs.

If the hinging of shutter 101*a* were to be of the same handedness as used for shutter 101*b*, there would be nothing to prevent such casual unwanted counterclockwise relative rotation of tube 80 from occurring. Because, however, hinge 110*a* is of opposite handedness to the hinge 110*b* of shutter 101*b*, any such incremental counterclockwise relative rotation of tube 90 around axis 82 would increase the wedging produced by shutter 101*a* in pivoting to its outer position (and the resilient deflection resulting from such wedging of shutter tongue 120*a*) so as, by such increase, to generate forces tending to oppose such incremental rotation of the tube. That is, such counterclockwise rotation of tube 80 (FIG. 10) would cause a further angular pivoting of shutter 101*a* clockwise to increase the wedging action to thereby generate such opposing forces. Of course the effect is symmetrical in that, if there were to be such an incremental relative rotation of the tube relative to the container in the other or clockwise direction, forces opposing the latter rotation would be similarly generated by shutter 101*b*. Hence, such incremental relative rotation of the tube and container in either angular direction is inhibited in the first instance.

To put it another way, by virtue of the shutters 101*a*, 101*b* angularly pivoting around their hinges in opposite of the clockwise and counterclockwise directions in moving from their inner to outer positions, the two shutters 101*a*, and 101*b* balance each other out in their tendencies to relatively rotate the tube and container in opposite angular directions, and the shutters cooperate to inhibit the tube and container against any such relative rotation, wherefore there will be no or a reduced tendency for there to be a loosening of the grip of the tube flange 90 and the shutters 101 on the container wall 31.

The described technique of providing that different ones of a plurality of radially spreadable hinged shutters pivot clockwise and counterclockwise, respectively, around their hinges in moving radially outward is useful even in those cases where the shutter hinges are not slanted as described above but where there is nonetheless a frictional grip between tube 80 and the container wall 31 as, say, where that grip is produced solely by the resilient deformation as described of the shutters. Moreover, while it is preferable for there to be an equal number of shutters having clockwise and counterclockwise directions of pivoting about their hinges, an advantage is realized even what that number is unequal as, say, where there are three shutters and one of them swings clockwise about its hinge and the other two swing counterclockwise. In such connection, it might be noted that the FIG. 3 and FIG. 6 tubes may both have four radially spreadable struts or shutters instead of the two which are shown and described above for them.

DETAILED DESCRIPTION OF FIG. 14 TUBE

FIGS. 14–17 disclose an embodiment of the invention constituting a payout tube which does not rely on friction to maintain a durable coupling between the tube and its container.

Figure 14:
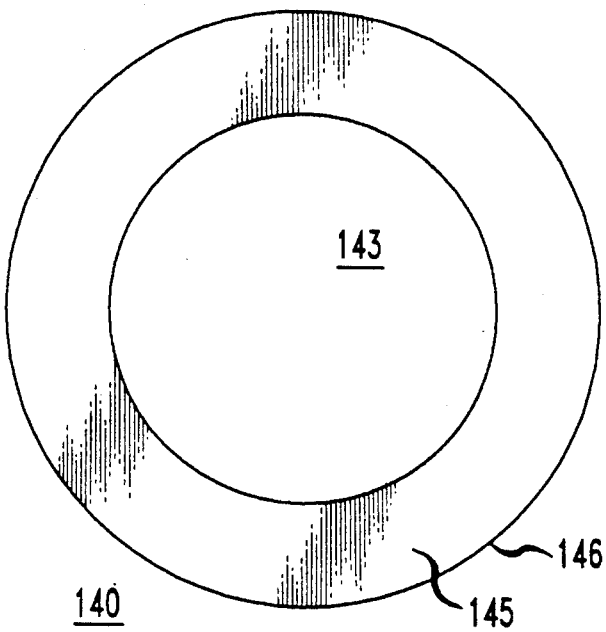
FIG. 14 is a plan view of a payout tube constituting a third embodiment of the invention.
Figure 15:
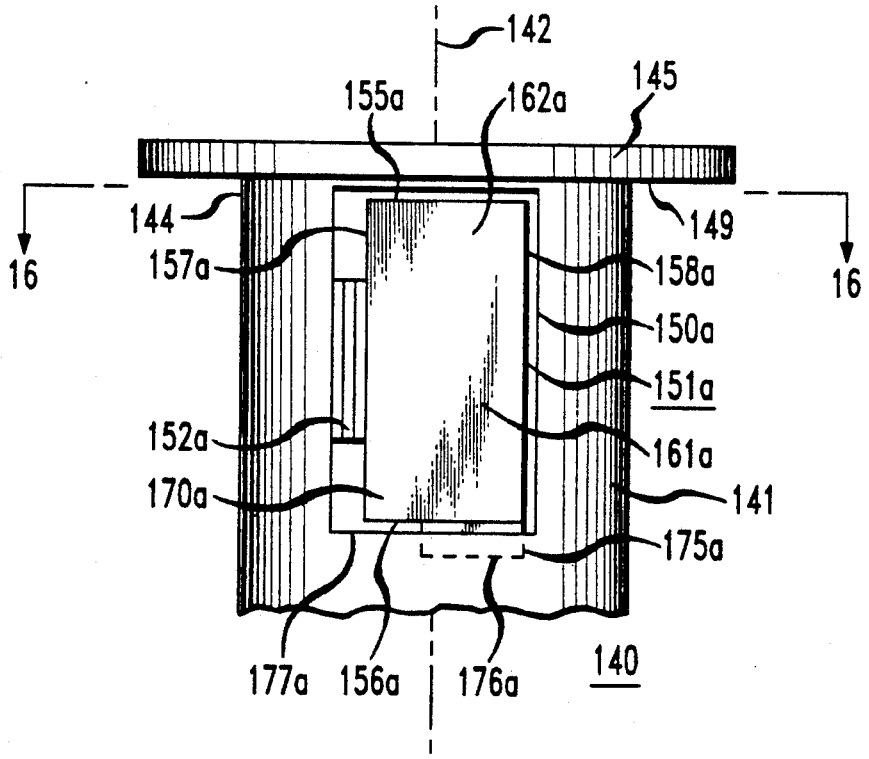
FIG. 15 is a broken-away left side elevation of the FIG. 14 tube.

In FIG. 14, the reference numeral 140 designates a payout tube which, like the other tubes earlier described herein, comprises a tubular sleeve 141 (FIG. 15) having an axis 142 and having therein a passage 143 (FIG. 16) axially extending through the sleeve. The sleeve 141 of tube 140 is of the same configuration as that shown in FIG. 7 for sleeve 81 of tube 80, and the passage 143 of tube 140 has therein a slitted diaphragm (not shown) similar to diaphragm 88 of the FIG. 7 tube. The tube sleeve 141 has at its exit end 144 a flange 145 radially projecting from, and extending continuously around, the sleeve and having a circular periphery 146. The axially forward surface 147 of flange 145 (FIG. 17) is coplanar with the front opening 148 of the tube.

The tube sleeve has formed therein four window apertures 150*a*–150*d* (FIG. 16) equiangularly spaced around the tube extending from rearward of sleeve 145 axially forward to terminations short of but close to the axially rearward surface 149 of flange 145. Apertures 150*a*–150*d* are shown (FIG. 16) as having therein corresponding struts in the form of shutters 151*a*–151*d* which are integral with sleeve 141 and coupled thereto by respective resilient hinges 152*a*–152*d* each joined on one and the other of its sides to, respectively, a side edge of the corresponding shutter and the main body of the sleeve. Shutters 151*a*–151*d* are accordingly parts which are extensions of such main body of sleeve 141.

Figure 16:
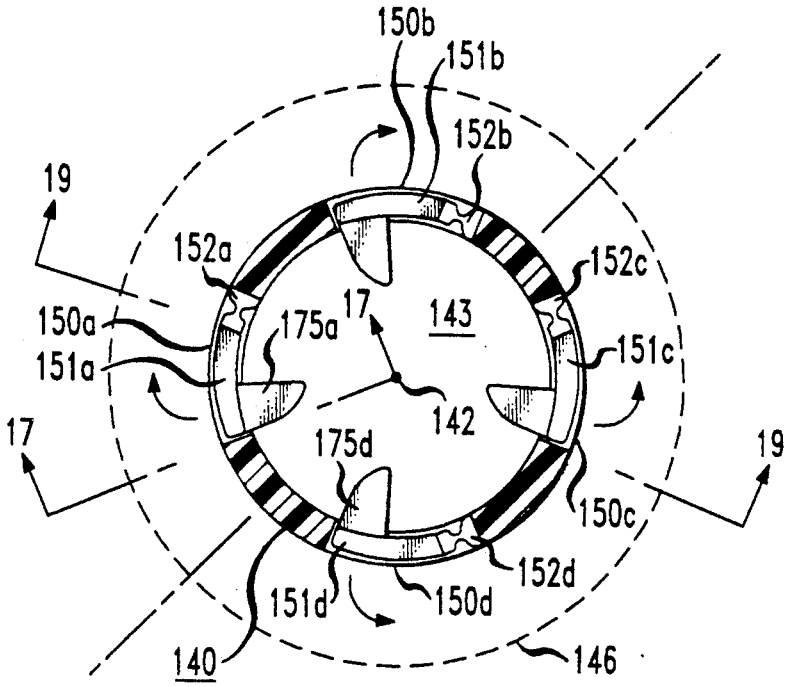
FIG. 16 is a plan view in cross-section, taken, as indicated by the arrows 16—16 in FIG. 15 of the FIG. 14 tube.

Referring to FIG. 16, as one travels in, say the clockwise direction around the tube 140, the hinges 152*a* and 152*b* are joined to edges of their shutters 151*a*, 151*b* which are lagging edges in relation to such travel, whereas the hinges 152*c* and 152*d* are drawn to edges of their shutters which are leading edges in relation to such travel. As a result, of the plurality of four shutters included in the FIG. 14 tube, two of them (shutters 151*a* and 151*b*) pivot clockwise about their hinges in moving from their radially inner to their radially outer positions, whereas the other two shutters pivot counterclockwise about their hinges in so moving. The shutters of the FIG. 14 tube thus stabilize that tube against casual rotation relative to container 30 (when the tube is secured to container wall 31) in the same way as described above in connection with the FIG. 6 tube. If desired, in going consecutively through the sequence of shutters 151*a*–151*d*, the shutters may alternate between clockwise and counterclockwise in the direction in which they pivot about their hinges in moving radially outward from the axis 142 of tube 140.

Considering the details of shutter 151*a* which is exemplary of the other shutters 151*b*–151*d*, that shutter for the most part is similar in structure and functioning to the previously described shutter 101*a* of the FIG. 6 tube. To wit, the main panel of shutter 150*a* has (FIG. 15) top and bottom margins 155*a*, 156*a*, an inner side edge 157*a* to which hinge 152*a* is joined, an outer side edge 158*a*, a central hinged section 161*a* axially coextensive with and outward of hinge 152*a* and an upper section or tongue 162*a* which extends axially forward from hinged section 161*a* to a free end of the tongue. The tongue 162*a* may (but need not) be resiliently deformable such that its free end is resiliently deflectable relative to hinged section 161*a* in the same way as is shown in FIG. 18 for the tongue 120*b* of shutter 101*b*.

Some differences of shutter 151*a* of the FIG. 14 tube from the shutter 101*a* of the FIG. 6 tube are as follows. The hinge 152*a* is not skewed relative to the tube axis 142 but, rather, has a centerline parallel to that tube. Also, the hinge 152*a* does not extend axially all the way to the bottom or rear edge 156*a* of the shutter. Hence, the main panel of the shutter 151 includes, in addition to its upper tongue 162*a*, a lower tongue 170*a* which extends downward from the shutter's hinged section 161*a* to the bottom margin 156*a* of the panel, and which lower tongue is resiliently deflectable similar to what is shown by FIG. 18 for the tongue 120*b*.

Figure 17:
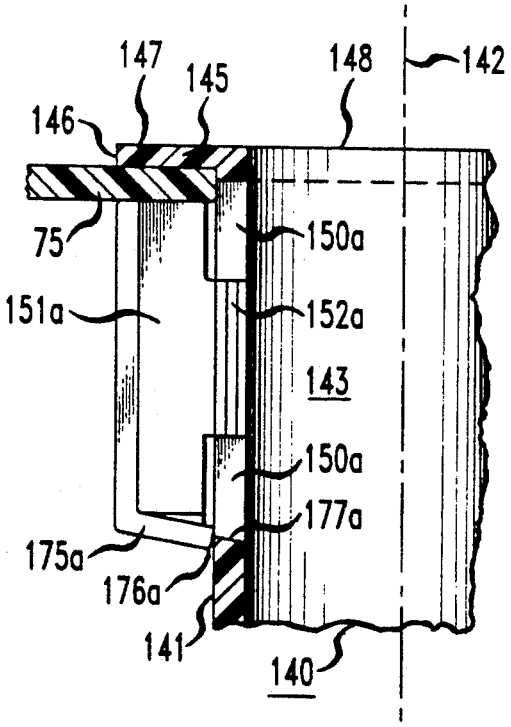
FIG. 17 is an elevation in cross-section, taken as indicated by the arrows 17—17 in FIG. 16, and showing a half of the FIG. 14 tube to the left of its axis in a diametrical plane, one strut of the tube being shown in full outer position, and the tube being shown as received in the container hole.

The tongue 170*a* has integral therewith a fender tab 175*a* joined to the tongue at its bottom margin 156*a* and projecting from the joinder away from the tongue in a radially inward direction to a free end 176*a* of the tab. The tab is resiliently deformable to permit its free end 176*a* to be deflected up and down relative to the base end of the tab at margin 156*a*. Moreover, the tab 176*a* from its joinder with tongue 170*a* slants downward in the direction away from the tongue to position the tab's free end 176*a* below the level of the lower edge or sill 177*a* of the window aperture 150*a* when the tab 175*a* is resiliently unstrained. As shown in FIG. 17 the surface of sill 177*a* may (but need not) have an upward slant in the radially outward direction.

USE OF FIG. 14 TUBE

The FIG. 14 Tube is used as follows. With all of its shutters being in their radially inner positions shown in FIG. 16, and with the tube being initially outside container 30 opposite hole 32 in its wall 31, the tube sleeve 141 is inserted, exit end 144 last, into hole 32 and advanced until the tube flange 145 bears on its inner side against the outer side of container wall portion 75 and other portions of the container wall 31 surrounding the hole 32. With contact between the flange and those wall portions being maintained, the shutters 151*a*–151*d* are each moved by hand or tool from their initially radially inner positions (FIG. 16) to radially outer positions at which a corresponding portion of container wall 31 bordering hole 32 will be interposed between the top edge of each shutter and the tube flange 145.

FIG. 17 depicts shutter 151*a* when it has been moved to that radially outer position at which wall portion 75 is interposed between it and tube flange 145. In the course of moving shutter 151*a* from inner to outer position, the bottom surface of fender tab 175*a* strikes the aperture sill 177*a* to cause the free end 176*a* of tab 175*a* to be increasingly deflected resiliently upward as radially outward movement of the shutter continues. As soon, however, as that movement carries the tab free end 176*a* past the aperture sill 177*a*, that free end will be restored to its normal position for a resiliently unstrained condition of tab 175 (and of tongue 170*a* if it is resiliently deformed by the deflection of the free end by the sill). When, however that restoration occurs, the free end 176*a* of the tab will be outside the exterior surface of tube sleeve 141 and below the height at that exterior surface of the aperture sill 177*a*. Accordingly, tab 175*a* now serves as a fender adapted by contacting such sleeve exterior surface to hold the main panel of shutter 151*a* in a radially outer position away from the sleeve. In the same way the tabs 175*b*–175*d* are adapted to hold their sleeves 151*b*–151*d* away from sleeve 141 in radially outer positions. That is, the FIG. 14 tube includes detent means comprising separable parts (tabs 175*a*–175*d* and the parts of sleeve 141 below the apertures which are contacted as described when such tabs are outside said sleeve parts) carried on, respectively, the tube struts and the tube sleeve and adapted by their cooperation to provide a detent action for retaining the struts in radially outer position once they have moved to that position.

When in such outer positions, shutters 151*a*–151*d* and flange 145, interact with the container wall portions between such shutters and flange to prevent substantial movement of tube 140 relative to container 30 in either of the axial directions of the tube. The tube and container are thus coupled together. In the case of the FIG. 14 tube, the maintaining of the shutters in radially outer position (and, thus the continuance of the tube-container coupling) does not depend on the presence of frictional contact between the shutters and the container wall portions interposed between them and tube flange 145. Thus, when the FIG. 14 tube is used, these wall portions may fit with play or clearance between such flange and shutters without risk of disruption of the tube-container coupling. Of course such play can be eliminated by choosing an axial spacing between flange 145 and the shutters 151 which is less than the thickness of container wall 31, and by utilizing resilient deformation of the upper tongues 162 of the shutters to absorb the difference.

FIG. 19 MODIFICATION

Figure 19:
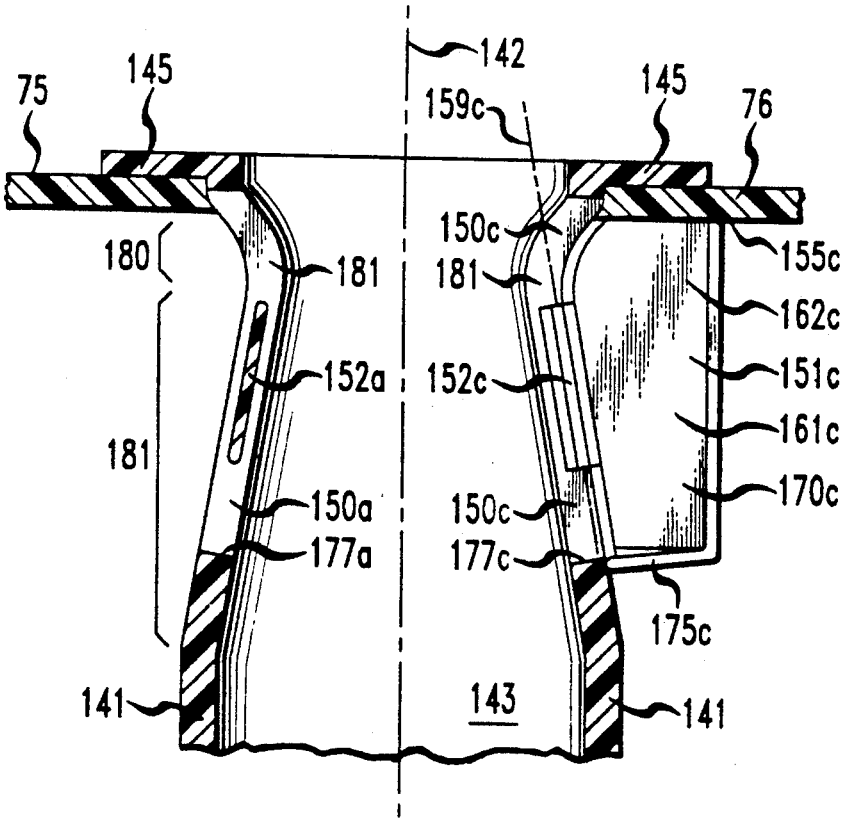
FIG. 19 is a broken-away elevation in cross-section of a modification of the FIG. 14 tube.

FIG. 19 shows a modification of the FIG. 14 tube enabling realization not only of the FIG. 14 tube's advantages (including locking of the struts or shutters in radially outward position without the use of friction) but also of the FIG. 6 tube's advantages (including wedging of the container wall between the flange of the tube and its struts or shutters as a result of relative motion between those tube elements).

In the FIG. 19 modification, the configuration of the tube sleeve is changed from circular cylindrical to that of a surface of revolution shaped to cause the sleeve, starting at flange 145 and proceeding axially rearward, to neck down over a sleeve section 180 to a minimum diameter throat 181 disposed no further down than the tops of the tube shutters and, from that throat, to have a linear divergent taper over a sleeve section 182 extending from throat 181 at least as far as the bottoms of the hinges of the tube shutters. Those hinges continue to be aligned (as they are in the unmodified FIG. 14 tube) with a linear segment of the generatrix line which revolves around the axis 142 of the tube to generate the configuration of the tube sleeve. However, because in the FIG. 19 modification those hinges are aligned with a segment of that generatrix line which creates the mentioned taper over section 181, the hinges become skewed or slanted in relation to the tube axis 142. Such skewing is shown in FIG. 19 by the hinges 152*a* and 152*c* and is characteristic of the other hinges 152*b* and 152*d* as well.

The skewing just described is different from the skewing of the hinges discussed in connection with the FIG. 6 tube in that in the FIG. 19 embodiment the centerlines of the skewed hinges lie in planes which pass through the tube axis and, also, coincide with the generatrix line which moves around that axis to sweep out the configuration of the tube sleeve, whereas, in the FIG. 6 tube, neither of those conditions holds. The FIG. 6 and FIG. 19 embodiments resemble each other, however, in that in each the effect of the skewing of the shutter hinges produces a wedging of the container wall between the flange of the payout tube and its struts or shutters. That wedging action has already been described for the FIG. 6 tube. Essentially the same wedging effect occurs in the FIG. 19 modification when the shutters 151 are angularly pivoted about their now slanted hinges 152 to move from their radially inner to their radially outer positions, the latter position being shown in FIG. 19 for the shutter 151*c*. A minor difference between the shutters of the FIG. 6 tube and the FIG. 19 modification is that the top edges of the shutters of the former tube are shown as being (although they need not be) normal to the centerline of the hinges for these shutters. In FIG. 19, in contrast, the top edges of the shutters may (but need not) make an angle slightly smaller than normal with the hinge centerlines, such reduced angle being exemplified by the angle existing in FIG. 19 between the top edge 155*c* of shutter 151*c* and the centerline 159*c* of the hinge 152*c* for that shutter.

Some advantages of the payout tubes described herein are as follows.

All of such tubes are usable with a hole in the container wall which, like the hole 32 (FIG. 2), is circular entirely around its circumference. Such a hole is easier to fabricate than is the notched hole disclosed by Zajac and, further, does not require flange means of a radius greater than the radius of such hole at the center lines of such notches in order to seal such hole against entry through the notches thereof, into the container, of dust and other extraneous objects or matter.

Moreover, all of such tubes are, as a practical matter, usable with a variety of containers having holes for the tubes which are surrounded by container walls of substantially varying thicknesses.

The FIG. 3 tube and the FIG. 14 tube are adapted to accommodate such variable thickness by virtue of the fact that portions of such wall around the hole will, despite relative angular turning of the tube and container, always remain between the flange means and struts of such tubes independent of the looseness or tightness or fit of such wall portions between those tube elements. Hence, and because the tube and container cannot be decoupled by any such turning, those flange means and struts can have an axial spacing large enough to accommodate a substantial variation in container wall thicknesses.

The FIG. 6 tube is adapted, on the other hand, to avoid such decoupling by moving its struts (shutters) relative to its flange means to produce the described wedging action so as to eliminate play in such fit and create friction between the tube and container wall preventing relative turning therebetween which might lead to such decoupling. The FIG. 19 modification is adapted to avoid such decoupling by the use of either one or both of the techniques described above in connection with the FIG. 3 and FIG. 14 tubes and the FIG. 6 tube, respectively.

Another advantage of the FIG. 6 and FIG. 14 tubes and of the FIG. 19 modification is that they conserve the amount of synthetic resinous material needed for incorporation in the tube. That is so because the shutters of such tube are constituted of portions of such material which ordinarily would be included in the tube sleeve. While a concomitant of the use of such material to provide these shutters is that apertures are left in the body of the sleeve, these apertures do not interfere with the feeding of the cable from the container interior out through the tube sleeve. The reason they do not do so is that such apertures provide no crevice or crack or the like in which the cable could be caught in passing through the sleeve.

The above described embodiments being exemplary only, it is to be understood that additions thereto, omissions therefrom and modifications thereof can be made without departing from the spirit of the invention. For example, without restriction, in the FIG. 3 tube the end tabs 66, 67 at the free ends of the struts 62, 63 may be extended axially forward and shaped on their radially outer sides to have planar faces which slant radially inward in the axially forward direction. In inserting the FIG. 3 tube into the container hole 32, such faces will contact the container wall material around that hole to deflect structs 62, 63 inward to permit them to pass axially through the hole. Thus, struts having such faces need not be deflected for that purpose by hand or by a tool.

Accordingly, the invention is not to be considered as limited save as is consonant with the scope of the following claims.

We claim:

1. A payout tube for a cable disposed in a coil in a container having an outlet hole for such tube in a wall of said container, said tube comprising: a tubular sleeve having an axis and having an axial passage therein with rear and front openings at entrance and exit ends of said sleeve for said cable, said sleeve being adapted in use to be mostly in said container but to have a portion at the exit end extend out through and beyond said hole, flange means radially projecting at said exit end away from the periphery of said sleeve, and a plurality of struts coupled to, and angularly spaced around, said sleeve and extending from rearward of said flange means axially forward to free ends of said struts disposed near to and in axially spaced relation from said flange means, said struts being radially movable between inner positions at which they are passable through said hole and outer positions at which said flange means and struts are adapted respectively to bear against opposite sides of portions of said wall adjacent to said hole so as to couple said tube and container.

2. A payout tube according to claim 1 in which said free ends of said struts are axially spaced rearward of said flange means.

3. A payout tube according to claim 1 in which said struts are integral with the main body of said sleeve.

4. A payout tube according to claim 1 in which said sleeve has formed therein a plurality of apertures angularly spaced therearound and extending in said sleeve from rearward of said flange means to terminations of said apertures adjacent to said flange means, and in which said struts constitute extensions into said apertures of the body of said sleeve and are radially movable inward and outward relative to said apertures between said inner and outer positions.

5. A tube according to claim 1 in which said struts at their free ends carry tabs integral with said struts and radially projecting therefrom, and in which said tabs on their sides towards said flange means are adapted to bear against said wall portions.

6. A payout tube for a cable disposed in a coil in a container having an outlet hole for such tube in a wall of said container, said tube comprising: a tubular sleeve having an axis and having an axial passage therein with rear and front openings at entrance and exit ends of said sleeve for said cable, said sleeve being adapted in use to be mostly in said container but to have a portion at its exit end extend out through and beyond said hole, flange means radially projecting at said exit end away from the periphery of said sleeve, a plurality of apertures formed in and angularly spaced around said sleeve, said apertures extending in said sleeve from rearward of said flange means axially forward to terminations of said apertures adjacent said flange means, and a plurality of struts formed as extensions into said apertures of the main body of said sleeve, each of said struts being coupled on one angular side thereof by a resilient hinge to said main body, and said struts being pivotable at their hinges relative to said main body to be radially movable between inner positions at which they are passable through said hole and outer positions at which said flange means and struts are adapted to respectively bear against opposite sides of portions of said wall adjacent said hole so as to couple said tube and container.

7. A payout tube according to claim 6 in which the resilient hinge for each strut is slanted relative to an intersecting line parallel to said axis so that angular pivoting in the radially outward direction of such strut about said hinge is productive of progressive incremental axial displacement towards said flange means of the portion of such strut nearest said flange means.

8. A payout tube according to claim 7 in which said resilient hinges are joined to flat portions in a cylindrical part of the main body of said sleeve and, moreover in the planes of such portions so that said resilient hinges are of straight line configuration.

9. A payout tube according to claim 7 in which said hinges lie within a linearly tapered section of said sleeve, and the centerlines of said hinges substantially coincide with the straight line intersections of planes passing through said axis of said sleeve with the cone defined by such tapered section.

10. A payout tube according to claim 7 in which said resilient hinges are substantially paralled to the axis of said sleeve.

11. A payout tube according to claim 6 in which one or more of said struts are movable clockwise from their inner to outer positions and one or more other of said struts are movable counterclockwise from their inner to outer positions.

12. A payout tube according to claim 6 in which said struts have free ends near to and axially spaced from said flange means, said resilient hinges are coupled to said struts over axial distances extending only part way to said free ends of said struts, and in which the axial extents of said struts from said hinges to said free ends are uncoupled from the main body of said sleeve and are resiliently deformable.

13. A payout tube according to claim 1 further comprising detent means operable upon movement of said struts from said inner to said outer positions thereof, and by cooperation of separate parts on, respectively, said sleeve and said struts to provide a detent action, for retaining said struts in the latter positions once they have been moved to such positions.

* * * * *